US008608905B2

(12) United States Patent
Leskela et al.

(10) Patent No.: US 8,608,905 B2
(45) Date of Patent: Dec. 17, 2013

(54) METHOD FOR PRODUCING FIBER PRODUCT

(76) Inventors: Markku Leskela, Muijala (FI); Jari Meuronen, Palokka (FI); Petri Silenius, Lohja (FI); Sami Haapala, Simpele (FI)

( * ) Notice: Subject to any disclaimer, the term of this patent is extended or adjusted under 35 U.S.C. 154(b) by 0 days.

(21) Appl. No.: 12/805,483

(22) Filed: Aug. 2, 2010

(65) Prior Publication Data

US 2011/0061826 A1 Mar. 17, 2011

Related U.S. Application Data

(63) Continuation of application No. 10/532,481, filed as application No. PCT/FI03/00797 on Oct. 24, 2003, now abandoned.

(30) Foreign Application Priority Data

Oct. 24, 2002 (FI) ..... 20021899

(51) Int. Cl.

| | |
|---|---|
| ***D21H 17/69*** | (2006.01) |
| ***D21H 17/67*** | (2006.01) |
| ***D21H 21/52*** | (2006.01) |
| ***D21F 11/04*** | (2006.01) |

(52) U.S. Cl.

USPC ..... 162/129; 162/128; 162/158; 162/181.1; 162/181.2; 162/185; 162/141; 106/464; 106/465; 428/221; 428/340; 428/372

(58) Field of Classification Search

USPC ..... 162/142, 158.1, 81.1, 181.2, 182, 162/185, 123, 132, 133, 141; 106/464, 465, 106/400, 401, 461, 463; 428/221, 340, 372

See application file for complete search history.

(56) References Cited

U.S. PATENT DOCUMENTS

| | | | | |
|---|---|---|---|---|
| 5,179,064 | A * | 1/1993 | Yonese et al. | 503/200 |
| 5,611,890 | A * | 3/1997 | Vinson et al. | 162/111 |
| 6,423,181 | B1 * | 7/2002 | Mendez-Gallon et al. | 162/128 |
| 6,712,931 | B1 * | 3/2004 | Gron et al. | 162/128 |

(Continued)

FOREIGN PATENT DOCUMENTS

| | | | |
|---|---|---|---|
| EP | 824157 | * | 2/1998 |
| EP | 1 054 100 | A2 | 11/2000 |

(Continued)

OTHER PUBLICATIONS

Certified translation of EP 824157 to Ruf et al, 1998.*

(Continued)

*Primary Examiner* — Matthew J. Daniels
*Assistant Examiner* — Dennis Cordray
(74) *Attorney, Agent, or Firm* — Kubovcik & Kubovcik

(57) ABSTRACT

This invention concerns the production of a multilayer fiber product. According to the method, on top of a bottom layer consisting of at least one fiber layer, a second fiber layer is fitted containing filler that forms the surface layer. According to the invention, the layers are formed by multilayer web forming technology, and the surface layer filler includes cellulose or lignocellulose fibrils, on which light-scattering material particles are deposited, having a maximum proportion of the total filler weight of 85%. By means of the invention, a base paper is achieved that is suited to thin, coated paper grades, where conventionally the intrusion of the coating color into the bottom paper and through it is a problem.

12 Claims, 6 Drawing Sheets

(56) References Cited

U.S. PATENT DOCUMENTS

| | | | | |
|---|---|---|---|---|
| 2001/0000063 | A1 | 3/2001 | Silenius et al. | 162/181.1 |
| 2001/0045265 | A1 | 11/2001 | Holik | 162/123 |
| 2004/0168779 | A1 | 9/2004 | Silenius et al. | 162/124 |

FOREIGN PATENT DOCUMENTS

| | | | |
|---|---|---|---|
| GB | 628603 | | 9/1949 |
| WO | 97/01670 | A1 | 1/1997 |
| WO | 02/092910 | A1 | 11/2002 |

OTHER PUBLICATIONS

Smook, Gary A., Handbook for Pulp and Paper Technologists, 2nd ed, Angus Wilde Publications, 1992, pp. 308-309.*

J. Peel, Paper Science & Paper Manufacture 1999, pp. 18-19.*

Silenius, P. "Improving the Combinations of Critical Properties and Process Parameters of Printing and Writing Papers and Paperboards by New Paper-filling Methods", Dissertation for the degree of Doctor of Science in Technology, Helsinki University of Technology, Feb. 14, 2003.*

Machine translation of EP824157, The European Patent Ofice, [online], [retrieved on Feb. 15, 2008]. Retrieved from the Internet<URL:http://v3.espacenet.com/results?sf=n&DB=EPODPC&PGS=10&CY=ep&NUM=EP824157&LG=en&ST=number>.

Certified translation of EP-824157, 2008, McElroy Translation Company.

* cited by examiner

METHOD FOR PRODUCING FIBER PRODUCT

This application is a continuation of application Ser. No. 10/532,481, filed Sep. 14, 2005 now abandoned, which is a 371 of international application PCT/FI2003/000797, filed Oct. 24, 2003, which claims priority based on Finnish Patent Application No. 20021899, filed Oct. 24, 2002, and which are incorporated herein by reference.

The present invention concerns a method for producing a multilayered fiber product having a thin base paper and a grammage of 80 g/m$^2$ at the most, the method comprising fitting on top of a bottom layer consisting of at least one fiber layer, a second fiber layer which contains a filler and which forms the surface layer of the fiber product.

According to a method of this kind, on top of a bottom layer consisting of at least one fiber layer there is fitted a second fiber layer, which contains a filler and which forms the surface layer of the fiber product.

In coating, the purpose of the base paper is to create problem-free operation conditions for the coating unit and finishing stages and to create a base for the coating during printing.

The grammage of normal LWC paper varies between 40 and 80 g/m$^2$, of which 6-15 g/m$^2$ per side comprises the coating layer. When moving towards lower grammage, the properties of the base paper become more critical. For thin paper grades, the coating layer cannot, by itself, compensate for the properties of the base paper, and because of this, in particular roughness and pore size (porosity) have great impact on the surface smoothness of the coated paper and, thus, also on the printing result.

Roughness increases when the roughness or the pore size increases in paper coated with low amounts of coating colours. By adding fines or fillers to the paper it becomes possible to decrease paper roughness.

It has been observed that, when using porous base paper, the coating penetrates strongly into the base paper structure in doctor blade coating or in film coating. A denser base paper provides improved covering. Poor covering is immediately visible as impaired quality or unevenness in the printing result or it can lead to an increase in the quantity of coating material required.

BACKGROUND OF THE INVENTION

The quantity of fillers in LWC base paper is normally 5-15%. Typically, approximately half of the filler is derived from coated rejected material and half comprises fresh feed. Fillers are used to improve the optical and printing properties of the paper, although paper strength properties suffer simultaneously. This may result in runnability problems at the paper machine. Furthermore, filler pigments are less expensive than fiber. It is therefore profitable to keep the quantity of fillers as high as possible.

A process for making multilayer webs by multilayer web technology is known from FI Patent No. 92729. In the process, there is a paper machine comprising a multilayer headbox, and different pulps are formed in at least two separate distribution funnels from the same fresh pulp and from the same pulp material deposit. The fresh pulp is fed from the material deposit and divided into several suspension flows, which are fed to the multilayer headbox. "The chemicals and/or additives relevant to quality and making economy" of different paper qualities are fed into the suspension flows.

Multilayer web technology is also described in FI Patent No. 105 118 and in EP Published Patent Applications Nos. 824 157 and 1 152 086.

It has been observed that layering of the pulp improves paper surface smoothness. For example, if mechanical pulp containing high quantities of fines is layered on the surface layer, the smoothness of the layer structure will be improved. If, at the same time, bulky chemical or mechanical pulps are placed in the middle layer, the bulk of the paper can also be improved.

It has further been observed that layering of the filler onto the surface layers improves sheet smoothness compared with the surface of the non-layered sheet.

In known technology, multilayer web technology is recommended for use in objects, where the quality of paper or board has generally been improved by pre-coating. These are writing and printing papers, fine papers (coated and non-coated), LWC base papers and SC papers, for example.

Although several problems related to conventional technology have been removed, the surface layer of a multilayer product still requires good formation, which is manifested as good printability in addition to smoothness. Thus, poor formation can most clearly be seen in the grey shades of offset printing and as a mottled printing surface. In order to improve the retention of the ordinary fillers, they are used together with retention agents. These agents cause flocking, which further decreases formation.

OBJECT OF THE INVENTION

It is an aim of the present invention to eliminate the drawbacks related to known technology and to provide an entirely new solution for making multilayer papers and boards. The purpose of this invention is, in particular, to provide a new process for making these multilayer products, where the surface is extremely smooth, air permeability resistance is high, the formation is high combined with good optical qualities (high opacity, ease of coating).

SUMMARY OF THE INVENTION

The invention is based on the idea of forming the different layers of a multilayer product from fresh pulps containing fibrous raw material using the multilayer web technology. In this technology, the furnish is prepared in the multilayer headbox of a paper machine for layering such that fillers and additives are added to the pulp used for the surface layer/layers of the multilayer product, and after this, the pulps are fed separately and combined immediately before the lip of the headbox, where the pulp slush jet is then fed onto the wire. According to the invention, the filler used in the surface layer is at least partially formed by a composite filler, which contains cellulosic or lignocellulosic fibrils, on which light-scattering material particles have been deposited in such way that their maximum content is 85% of the weight of the filler. These types of fillers are disclosed in our FI Patent Specification No. 100729.

According to the present invention it has surprisingly been found that when the surface layer of a multilayer product is filled with the above mentioned filler, the opacity of the surface increases so much that the grammage of the surface layer can be significantly decreased.

Furthermore, in this invention it has been observed that, in addition to the above mentioned low-cost filler, other corresponding fillers can also be used, which at least partially consist of cellulosic or lignocellulosic fibrils, on which light-scattering material particles are deposited. These particles are typically inorganic salts, such as calcium carbonate, calcium sulphate, barium sulphate or calcium oxalate that are precipitated in aqueous phase.

The use of composite fillers in multilayer products is disclosed in our previous FI Patent Application No. 20010848. There is no mention of the multilayer web technology in that application. Instead, the application suggests combining the separate layers by vat lining. In the present invention, the layers are formed simultaneously by multilayer web technology and they are dried on the wire, to which they are fed simultaneously from the lip of the headbox.

US Patent Application No. 2001/0045265 discloses a process and a device for producing a multilayer web, where calcium carbonate is precipitated on at least one fiber layer in connection with the web making. In the reference, the calcium carbonate is not precipitated on fibrils, but on the fibrous material.

More specifically, the method according to the invention is characterized in that the layers are formed by using multilayer technology, and the filler of the surface layer consists at least partially of cellulose or lignocellulose fibrils, on which light-scattering material particles are deposited, the maximum content of which is 85% of the total weight of the filler.

ADVANTAGE OF THE INVENTION

Considerable benefits are achieved with this invention. Thus, with the help of the invention, paper having even quality and a high formation level can be produced at good retention. In addition, the recirculation waters become significantly cleaner and the need for retention agents decreases. Improved formation results in a smoother paper having improved gloss. The improved smoothness is a significant factor as illustrated in the examples below: it is surprisingly good and considerably much higher than what was expected. If the paper is coated, the coverage of the coating is better than with conventional, mineral-based fillers. This makes it possible to use smaller quantities of coating. Moreover, problems related to unevenness of gloss and of the printing results are decreased.

The present products can be used in writing and printing papers (coated and non-coated fine papers, LWC and SC papers) and in different kinds of boards. According to the invention, the multilayer product has high density, which is why the invention is particularly advantageous for thin, coated paper qualities (LWC, SC), in which coating color intrusion inside the base paper, and through it, is a conventional problem.

Due to their density and good air permeability resistance, product types based on the invention are also applicable for usages where barrier qualities are of importance. Examples of these types are envelope papers, barrier papers and barrier boards in food and cleanser packages.

It has been observed that the filler improves surface layer formation and structural stiffness. The filler disclosed in FI Patent Specification No. 100729, for which the product name "SuperFill" is also used in the following, has good retention, whereby the quantity of retention agent can be decreased and yet the system remains cleaner. Improved retention also promotes a decrease in optimisation/dosing of other paper making additives. Cleanliness favours runnability of the machine and, in general, machine operating efficiency improves, because the number of stoppages decreases.

Compared to the embodiment described in US Application No. 2001/0045265, a considerably much greater increase in opacity is attained by using the SuperFill filler (or corresponding one) according to the invention. In the embodiment of the US Publication, the surface layers contain PCC precipitated on top of the fibers, whereby no significant sealing effect can be achieved. In addition, there is no mention that the paper would be coated in the publication.

According to a preferred embodiment of the invention, a thin multilayer base paper, with a maximum square weight of approximately 80 g/m$^2$, is produced.

DETAILED EXPLANATION OF THE INVENTION

Figure 1A:
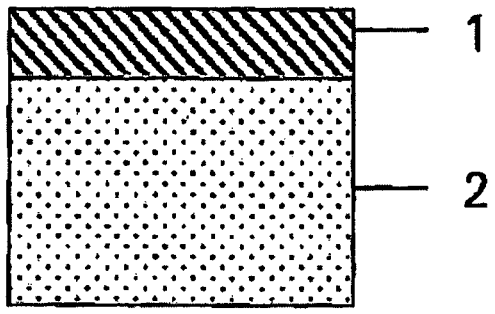
FIG. 1*a* depicts in side view the principle of a two-layer fiber product structure.

In the following, the invention will be examined more closely with the aid of a detailed description and a number of working examples.

The Filler and the Production Thereof

As mentioned above, according to the invention, composite fillers are added to the surface layer of the multilayer fiber product, which comprises cellulose fibrils, on which light-scattering pigments are attached. The fibrils can originate from chemical pulp or mechanical pulp or from a combination of these two. Chemical pulp means, in this context, a pulp that has been treated with digestion chemicals for the delignification of cellulose fibers. According to one preferred embodiment, the fibrils used in the invention are fibrils obtained by beating from pulps prepared by the sulphate process and by other alkaline processes. In addition to chemical pulps, the invention is also suited for fillers produced from fibrils obtained from chemimechanical and mechanical pulps.

Typically the average thickness of cellulose or lignocellulose fibrils is smaller than 5 μm, normally smaller than 2 μm. The fibrils are characterized by one or both of the following criteria:

a. they correspond to a fraction which passes a 100 mesh screen;
b. their average thickness is 0.01-10 μm (most suitably at maximum 5 μm, in particular at maximum 1 μm) and their average length is 10-1500 μm.

The source material for the fibrils, i.e. the fines based on cellulose or other fibers, is fibrillated by beating in a pulp refiner. The desired fraction may, when necessary, be separated using a screen, but the fines need not always be screened. Suitable fibril fractions include wire screen fractions P50-P400. Preferably, refiners with grooved blades are used.

The light-scattering material particles in the filler are inorganic or organic salts, which can be formed from their source materials by precipitation in an aqueous medium. Such compounds include calcium carbonate, calcium oxalate, calcium sulphate, barium sulphate, and mixtures thereof. The material particles are deposited on the fibrils. The amount of the inorganic salt compound in relation to the amount of fibrils is approx. 0.0001-95% by weight, preferably approx. 0.1-90% by weight, most suitably approx. 60-80% by weight, calculated from the amount of filler, and approx. 0.1-80% by weight, preferably approx. 0.5-50% by dry weight of the surface layer.

The invention is discussed below by using the product according to FI Patent Specification No. 100729 as an example, but it is clear that it is possible to use in the invention any other of the above-mentioned products, which contain various light-scattering pigments.

The filler is prepared by depositing the mineral pigment on the surface of fine fibrils prepared from cellulose fibers and/or mechanical pulp fibers. For example, the precipitation of calcium carbonate can be carried out by feeding into an aqueous slush of fibrils an aqueous calcium hydroxide mixture, which possibly contains solid calcium hydroxide, and a compound that contains carbonate ions and is at least partly dissolved in water. It is also possible to introduce carbon dioxide gas into the aqueous phase, which gas in the presence of calcium hydroxide produces calcium carbonate. There form string-of-pearls-like calcium carbonate crystal aggregates which are held together by fibrils, i.e. fine strands, and in which the calcium carbonate particles are deposited onto the fine fibrils and attached to them. The fine fibrils together with calcium carbonate form string-of-pearls-like strands, which primarily resemble strings of pearls in a pile. In water (slush) the ratio of the effective volume of the aggregates to the pulp is very high compared with the corresponding ratio of conventional calcium carbonate used as filler. By effective volume is meant the volume required by the pigment.

The diameter of the calcium carbonate particles in the aggregates is approx. 0.1-5 μm, typically approx. 0.2-3 μm. Usually fibrils corresponding in the main (at least more than 55%) to wire screen fractions P50-P400 are used.

A filler of this particular kind is added to the surface layer of the multilayer product from 1 to 90% by weight of the fibers (dry weight), typically approximately 5-50% by weight. Usually, the filler described forms at least 5% by weight, most suitably from 10 to 100% by weight, of the filler of the base web, and correspondingly 10 to 50% by weight of the fiber material of the base web. In principle, it is also possible to produce a base web, where the fiber material consists in entirety of the filler fibrils, so that, in general, this filler can form 1 to 100% by weight of the fiber material of the base web.

In the furnish used in the production of the surface web, a part of the filler can consist of conventional fillers, such as calcium carbonate. However, preferably at least 80%, especially preferably at least 90%, of the precipitated light-scattering pigment particles are attached to the fibrils.

Multilayer Structure

Figure 1B:
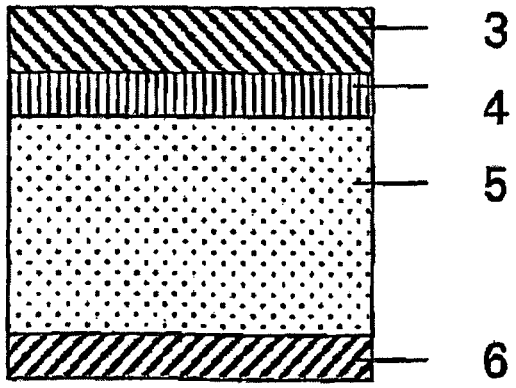
FIG. 1*b* shows the structure of a corresponding four-layer fiber product.

FIGS. 1*a* and 1*b* depict in sideview the structure of multilayer products containing two and four layers, respectively.

A product according to this invention can be a liner, a two-layer product (see FIG. 1*a*) that includes a surface layer (or cover layer) 1 and a back layer 2. The surface layer covers the back layer in such way that the back layer is not visible through the surface layer.

It is also possible to produce three-layer or four-layer products. In principle, the number of layers in a layer product has no upper limit; there can be even up to 5, 6 or 7 layers. What is essential for this invention is that the surface layer contains filler described more precisely hereinbefore, in a way that the surface layer covers the layers beneath it and which can be produced from economically viable raw materials.

The multilayer products, which can be mentioned, include four-layered products of the type known as test liners, with a surface layer 3, a layer 4 beneath the surface layer, a middle layer 5 and a back layer 6, which are shown in FIG. 1*b*.

A particularly advantageous product comprises three layers, i.e. two surface layers and a middle layer between them. A base paper of this kind is excellent for lightly coated printing papers, such as LWC papers.

Different raw materials can be used to produce fiber products according to their intended utility. Both virgin fibers and recycled fibers can be used. Virgin fiber can originate from softwood or hardwood (wood chips) or it can originate from sawdust. Virgin pulp is especially preferably used in the surface layer. This is most suitably produced with sulphate cooking (kraft pulp), because sulphate cooking produces a pulp with particularly suitable strength properties, as the name suggests. Recycled fiber can originate e.g. from used corrugated board packages (OCC) or from mixed fibers. Recycled fibers are used especially for the production of test liners. The surface layer and the back layer(s) can be produced from identical raw materials or from different source material fibers. If virgin fiber, such as kraft pulp, is used for both, then the pulp of the back layer can be cooked in high yield, after which mild beating is performed on it. Pulp that has been cooked to a lower kappa and which has also been beaten more than the pulp of the back layer is used for the top layer. Typically, the pulp of the back layer is cooked to a kappa value of 30-70, and the pulp of the top layer to below the kappa value of 25 (the kappa number of unbleached pulp). Bleaching can be carried out in a manner known per se, e.g. by ECF or TCF bleaching.

Retention agents can be added to the slush e.g. in approximately 0.5 to 3% of the total quantity of the fiber material. However, it has been observed in connection with this invention that the filler described herein provides so good retention that no retention agents are necessarily required in the layer or that the quantity of the retention agents can be significantly decreased. The layered product can be stock or surface sized to improve moisture resistance. If a low quality recycled fiber is used as raw material, it is preferred to use a surface-size press to produce a product with sufficient strength. Depending on the products, the total surface layer weight in relation to the total middle layer(s) weight varies so that it is approximately 20/80 to 80/20, typically approximately 30/70 to 70/30. In general, the ratio is approximately 35/65 to 65/35. Typically, the grammage of the surface layer is approximately 5 to 125 g/m$^2$ (see below). When acting according to this invention, the grammage of the surface layer can be decreased by over 10%, even by 20% or more, without deteriorating the optical or mechanical properties of the cover.

Products

It is particularly preferred to produce a three-layer fiber product, with a preferred grammage (non-coated base paper) of approximately 20-100 g/m$^2$, typically approximately 25-60 g/m$^2$, the grammage of one surface layer being approximately 2-50 g/m$^2$, preferably approximately 5-20 g/m$^2$. In such a product, the grammage distribution between the surface and the back layers (middle layer/layers) is, in particular, approximately 36/65 . . . 65/35. The same distribution may also be created in two-layer or four-layer products, respectively.

The invention can be applied, for example, to making products, where the bottom layer contains chemical cellulose pulp and the surface layer contains cellulose or, preferably, mechanical pulp, respectively.

As an example of the products provided by the present invention, thin paper grades (less than 80 g/m$^2$, especially preferably less than 60 g/m$^2$) can be mentioned; in these products, the conventional problem of coating colour intrusion through the base paper is solved. Here smoothness, coating ease and retention can be improved and coating color intrusion into the base paper can be prevented. In this way, a smaller quantity of coating colour is required for filling surface unevenness and, despite decreasing the quantity of coating color applied, improved coverage is achieved. This is how the densifying effect of the SuperFill filler can be especially efficiently utilised; paper becomes thinner, more dense and it is easier to coat.

According to this invention, filler is applied more to the surfaces and less in the middle. The filler fed into the middle layer is primarily pulp obtained from slushing of reject web.

A particularly preferred embodiment of the present invention comprises the base paper of LWC paper. Here, both the bottom layer and the surface layer/layers comprise a mixture of chemical cellulose pulp and mechanical pulp, whereby the bottom layer is formed using mechanical pulp, which is coarser than the pulp used for forming the surface layer.

Forming the Multilayer Web

In this invention, multilayer technology is applied for making a multilayer product. This process enables the layering of the additives, fillers and fine materials. Applicable pulp feeding arrangements are described in FI Patent Specification No. 105 118 and in EP Patent Application No. 824 157, for example.

The multilayer headbox is used most preferably in combination with a so-called "gap former". In this device, the lip jet is fed between two wires and the water is removed from the pulp via the wires in two different directions. With a gap former, the fine material is gathered on the surfaces of the layer and the filler distribution takes up a "smiling" shape. When the multilayer headbox is used in combination with the gap former, the desired multilayer structure is obtained simply by feeding the paper or board pulp in layers between the wires as described hereinbefore. With this technology, products with thinner layers than in ordinary multilayer technology can also be produced.

In practice, the method applied may be similar to the one described in EP Patent Application No. 824 157, whereby the pulp is layered in the multilayer headbox in such a way that the composite filler is included in the suspension flows directed to the surface layers. These flows may include additives, such as starch compounds and, possibly, retention substances. As we have indicated in our copending application, the retention of the new composite fillers is so good that it is possible to achieve good retention without separate retention aids, which improves the formation of the surface layer. The suspension flows are directed away from each other by separation using plastic separating plates for example into two, three or more flows to the lip of the headbox, at which they are combined into one single, layered pulp flow. From the lip, the pulp is fed to the gap formed by, e.g. the gap former, at the wire part, from where it is led past the dewatering devices of the wire to the press section of the paper machine. From the press section, the pulp is fed into the drying section, where it is dried by methods known per se.

The dried paper or board web can be coated in either an online or offline coater with, for example, calcium carbonate, gypsum, aluminium silicate, kaolin, aluminium hydroxide, magnesium silicate, talc, titanium oxide, barium sulphate, zinc oxide, synthetic pigment or a combination of these.

This invention is further illustrated in the following examples. In Examples 1 and 2, the benefits of layering are illustrated compared to non-layered paper with the help of laboratory sheets. In these examples, a significant improvement in smoothness and in air permeability is noticed. In Example 3 the air permeability effect of the SuperFill filler material compared to normal PCC's in ordinary non-layered sheets is illustrated. The measurement results were determined in accordance with the following standard procedures:

Surface roughness: SCAN-P76:95 and

Air permeability resistance: SCAN-M8, P19

EXAMPLE 1

Producing Layered Sheets with Multilayer Mould 1

In the test series, laboratory sheets were made with a special multilayer sheet mould.

With the multilayer mould it is possible to layer pulp with different pulp, filling and chemical characteristics into three different pulp layers. After the sheet has been produced, it is wet pressed and dried at standard conditions.

The grammages of the completed sheets were 36-37 g/m$^2$ and the filler content in the sheets was 12-15%. The PCC content in the SuperFill was 67.5% and the carrier in the SuperFill was ECF bleached birch pulp (Äänekoski). The SuperFill product was made according to Example 1 of FI Patent Specification No. 100729.

The test point structures of the layered products are illustrated in Table 1.

TABLE 1

| Test Points | | |
|---|---|---|
| Layer ratios | Test point 5 | Test point 7 |
| 33 | Cellulose/TMP accept/PCC/ret | Cellulose/TMP accept/SF/ret |
| 33 | Cellulose/TMP reject | Cellulose/TMP reject |
| 33 | Cellulose/TMP accept/PCC/ret | Cellulose/TMP accept/SF/ret |

Test point 5 is produced as follows:

The portion of cellulose in the total pulp is 40%, which was added in equal quantities in each layer, TMP reject pulp (TMP reject) was used in the middle layer, no fillers or chemicals, TMP accept pulp (TMP accepts) was used in the surface layer, with commercial PCC filler (PCC) and retention chemicals (ret).

Test point 7 differs from test point 5 only in terms of the filler, where the commercial PCC filler has been replaced by SuperFill filler (SF).

Test point 8 describes normal one-layer sheet, where the filler used is SuperFill.

The commercial retention material used was the chemical Percol 47.

TABLE 2

| | Test point 5 | | Test point 7 | | Test point 8 | |
|---|---|---|---|---|---|---|
| Grammage, g/m$^2$ | 36.3 | | 36.1 | | 36.8 | |
| Thickness, μm | 77 | | 72 | | 78 | |
| Density, m$^3$/g | 471 | | 501 | | 472 | |
| Bulk, kg/m$^3$ | 2.12 | | 1.99 | | 2.12 | |
| Air permeability, ml/min | 1090 | | 578 | | 1230 | |
| Bendtsen roughness/ ml/min | sp* | rs** | sp* | rs** | sp* | rs** |
| | 182 | 111 | 143 | 144 | 227 | 1170 |

sp* = smooth side rs** = rough side

Figure 2:
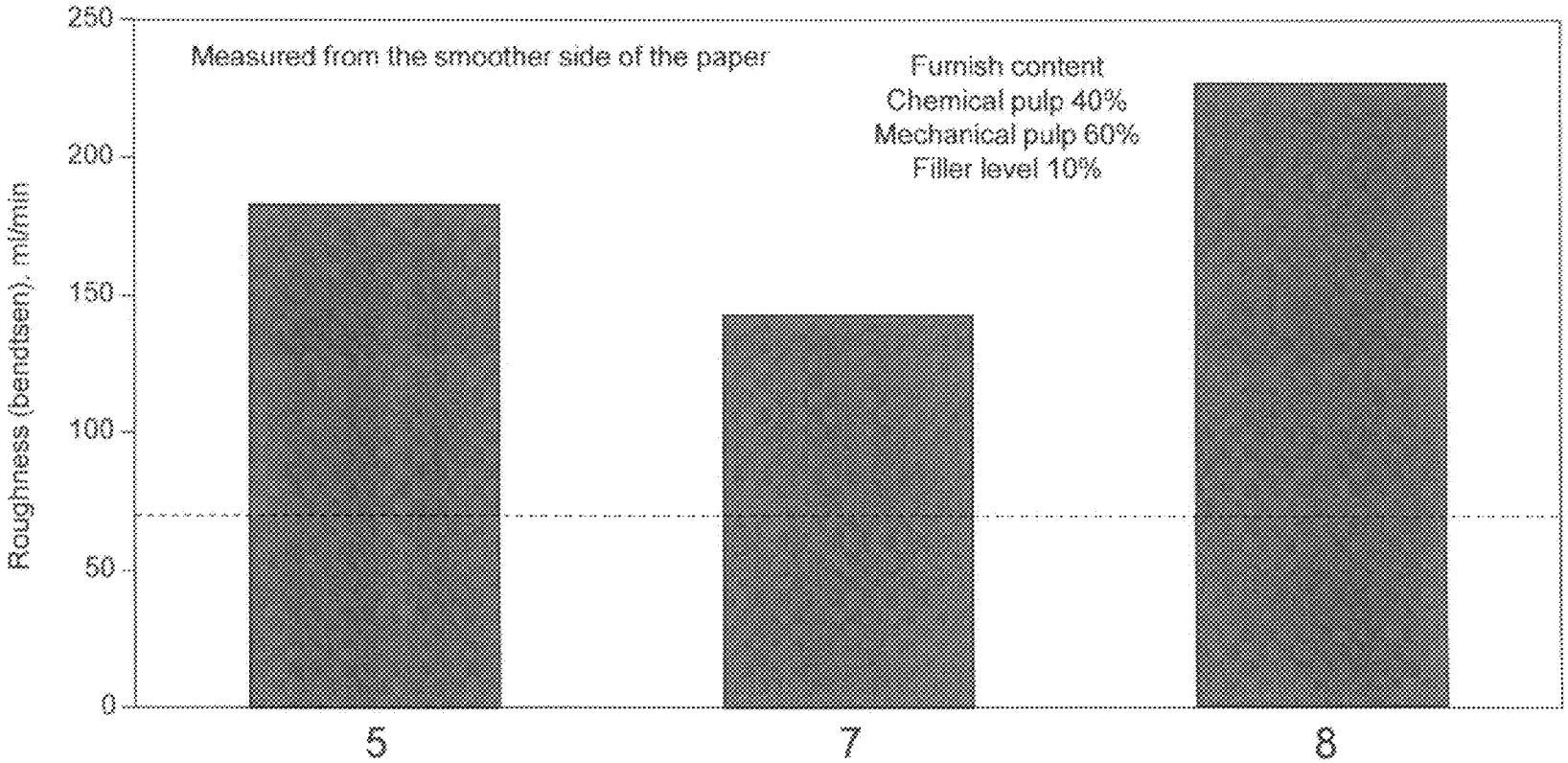
FIG. 2 illustrates the smoothness (roughness) of the products in Example 1 with bar charts.
Figure 3:
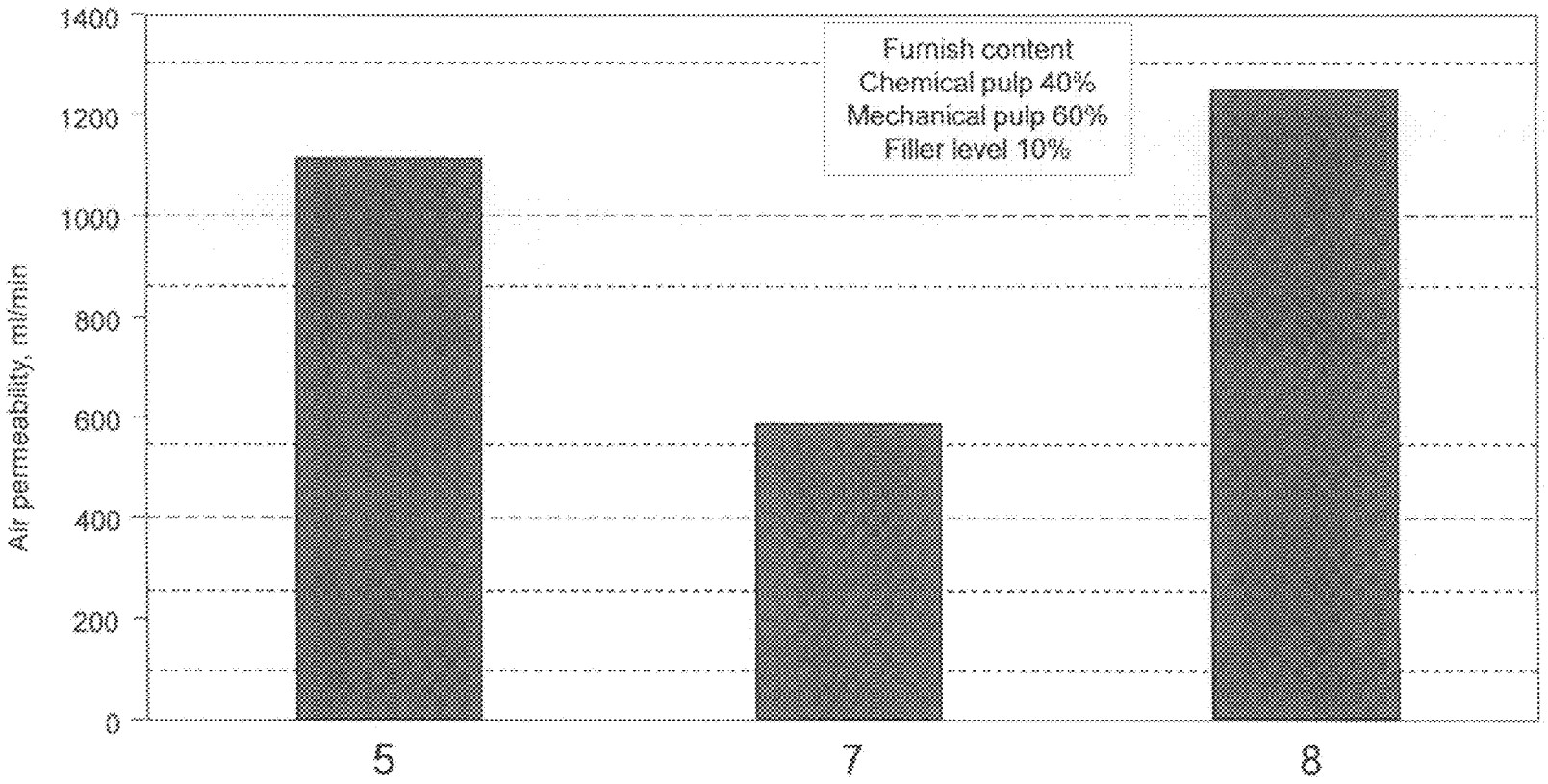
FIG. 3 illustrates the corresponding results for air permeability.

These results are illustrated also in graphic form in FIGS. 2 and 3.

The distribution of the layered filler in the sheets indicates that the surface layer contains 15-20%, and the middle layer approximately 5% of the filler. The target filler content of the sheets was 10%, which indicates that the layering of the filler to the surface layers succeeded well.

The roughness of the surface (roughness) is decreased when the filler is layered in the surface layers (approximately 40% smoother surface). By replacing this SuperFill filler with commercial PCC, the benefit of this smoothness is decreased by half, as the benefit to the non-layered SuperFill sheet is only 20%.

The air permeability resistance of the sheets (Air permeability, in FIG. 3 air permeability) increases significantly by layering the SuperFill filler into the surface layers (over 50% denser structure). By replacing this SuperFill filler with commercial PCC, this density benefit is practically completely lost. The benefit to the non-layered SuperFill sheet is only 10%.

EXAMPLE 2

Making Layered Sheets with a Multilayer Mould 2

In the test series, laboratory sheets were made with a special multilayer sheet mould.

With the multilayer mould it is possible to layer pulp with different grades of pulp, filler and chemicals into three different pulp layers. After the sheet has been produced, it is wet pressed and dried in standard circumstances.

The grammages of the completed sheets were 36-37 g/m$^2$ and the filler content in the sheets was 12-15%. The PCC content in the SuperFill was 67.5% and the carrier material in the SuperFill was ECF bleached birch pulp (Äänekoski). The SuperFill product was made according to Example 1 of FI Patent Specification No. 100729.

The test point structures of the layered products are illustrated in Table 3.

TABLE 3

| | Test points | |
|---|---|---|
| Layer ratios | Test point 10 | Test point 11 |
| 30 | TMP accept/PCC/ret | TMP accept/SF/ret |
| 40 | Cellulose | Cellulose |
| 30 | TMP accept/PCC/ret | TMP accept/SF/ret |

Test point 10 is produced as follows:

The cellulose content in the total pulp is 40%, which was added in equal quantities to each layer, The middle layer contained no fillers or chemicals, TMP accept pulp (TMP accept) was used in the surface layers, with commercial PCC filler (PCC) and retention chemicals (ret).

Test point 11 differs from test point 10 only in the sense that the commercial PCC was replaced with SuperFill filler (SF).

Test point 8 illustrates a normal one-layer sheet, where the filler is SuperFill.

The commercial retention chemical used was the chemical Percol 47.

During the test series, the screen type was changed into a more porous type. Test points 10*b* and 11 (layered sheets) can therefore be compared with test points 8 (non-layered sheet) only with the help of test point 10*a*. Test points 8 and 10*a* were produced with the same screen.

TABLE 4

| | Test point 8 | | Test point 10a | | Test point 10b | | Test point 11 | |
|---|---|---|---|---|---|---|---|---|
| Grammage, g/m$^2$ | 36.8 | | 36.1 | | 35.7 | | 35.0 | |
| Thickness, μm | 78 | | 76 | | 78 | | 71 | |
| Density, m$^3$/g | 472 | | 475 | | 458 | | 493 | |
| Bulk, kg/m$^3$ | 2.12 | | 2.11 | | 2.18 | | 2.03 | |
| Air permeability, ml/min | 1230 | | 780 | | 476 | | 274 | |
| Bendtsen roughness/ ml/min | ss* 227 | rs** 1170 | Ss* 71 | rs** 71 | ss* 127 | rs** 792 | ss* 97 | Rs** 861 |

ss* = smooth side rs** = rough side 10a-10b: type of screen changed

Figure 4:
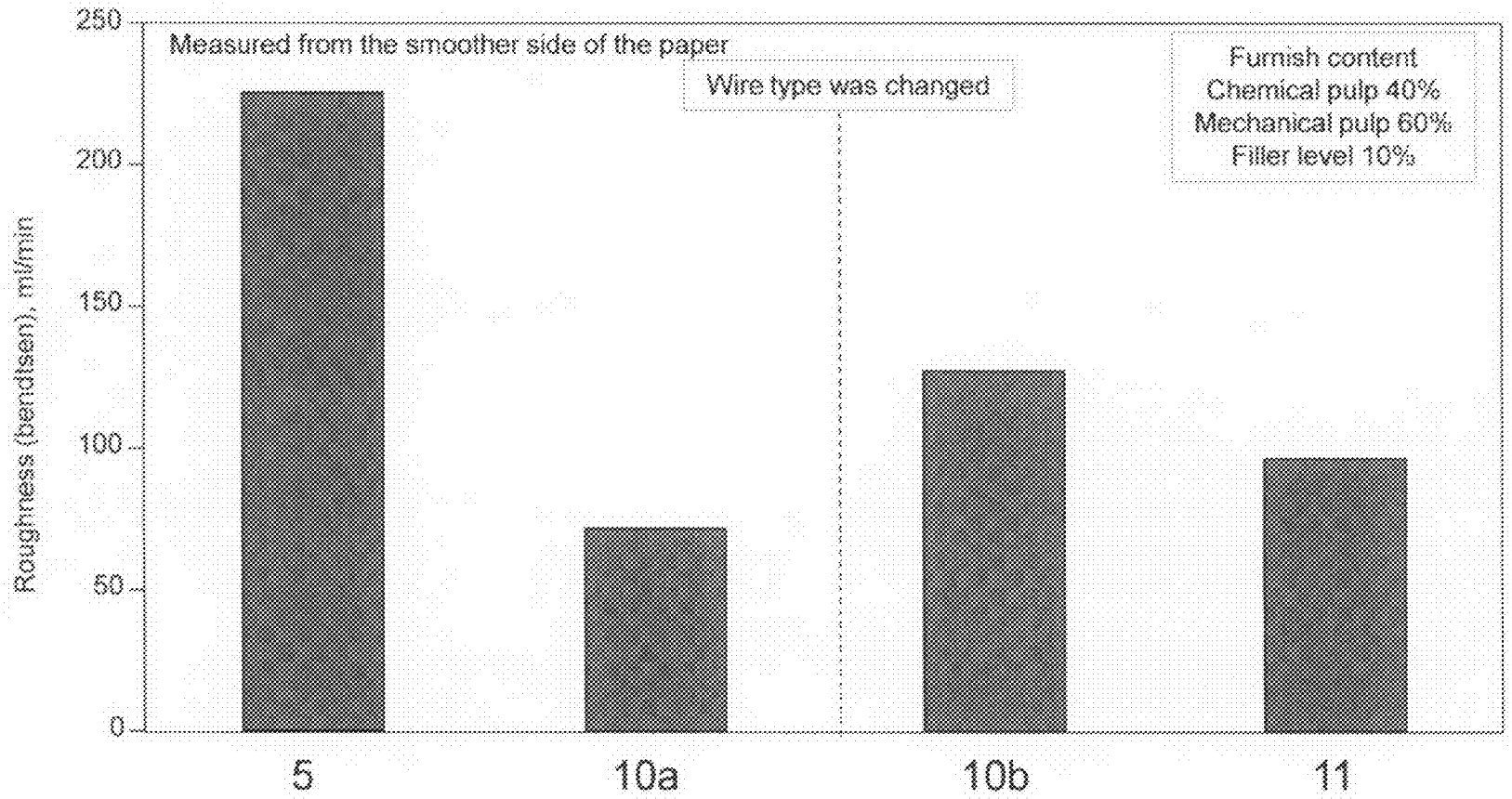
In FIG. 4, the smoothness (roughness) of the products illustrated in Example 2 has been illustrated with bar charts.
Figure 5:
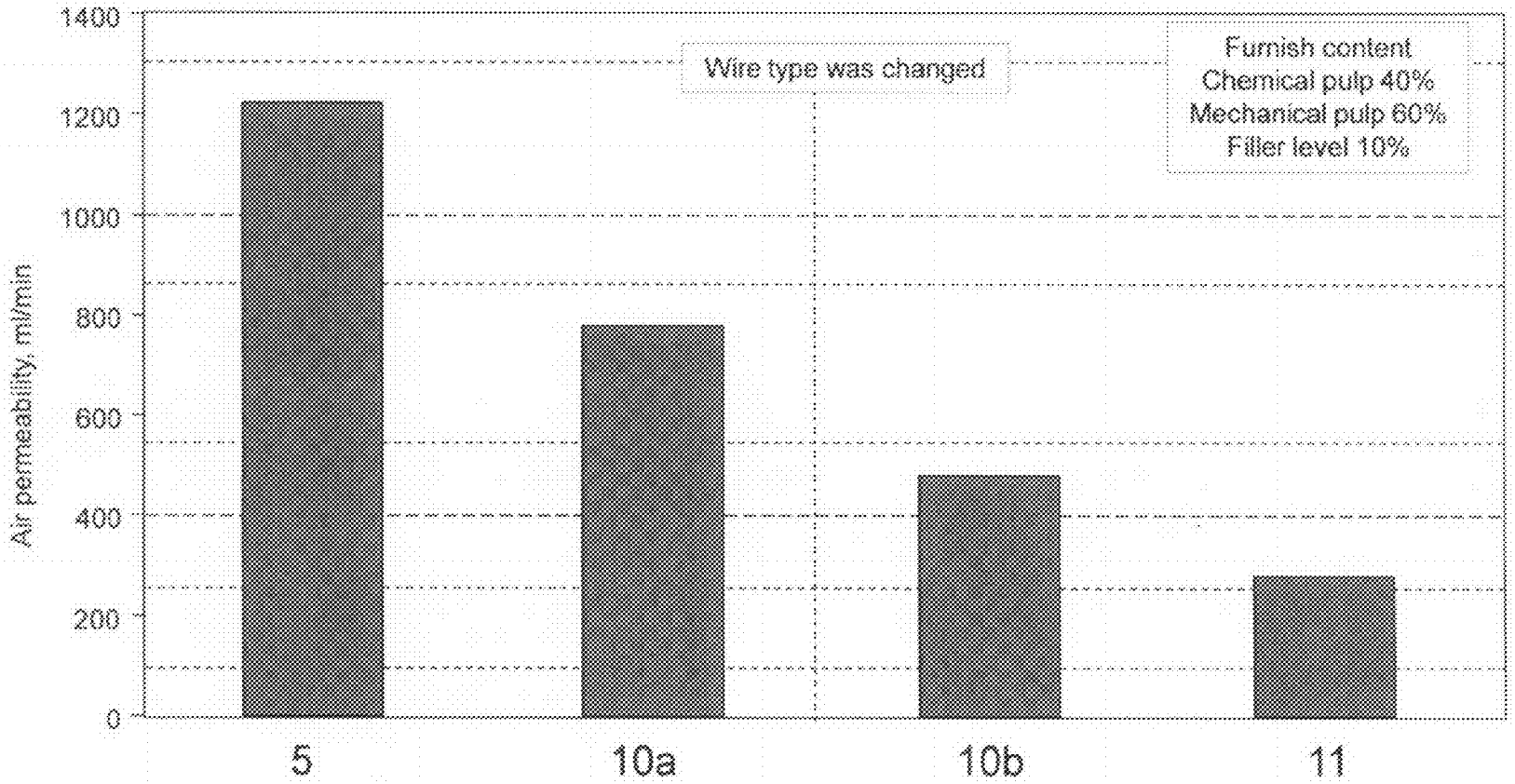
In FIG. 5, the corresponding results for air permeability resistance are illustrated; and In FIG. 6 a graphic illustration indicates the air permeability of the fillers as a mineral pigment mathematical function.

These results are also graphically depicted in FIGS. 4 and 5.

The distribution of the layered filler in the sheets indicates that the surface layers contain 15-20% and the middle layer approximately 5% of the filler. The target filler content of the sheets was 10%, which shows that the layering of the filler to the surface layers had been well accomplished.

The roughness of the surface (roughness) is decreased by layering the commercial PCC filler in the surface layers (approximately 70% smoother surface). By replacing the PCC with SuperFill filler, this smoothness is further increased (approximately 25% smoother surface).

The air permeability or density of the sheets (Air permeability, in FIG. 5 "air permeability") increases significantly when the commercial filler is layered in the surface layers (approximately 35% denser structure). By replacing this commercial PCC quality with SuperFill filler, the density further increases by approximately 40%.

EXAMPLE 3

Producing Hand Sheets with Different Fillers

In a test series, hand sheets were made with a normal sheet mould using different fillers. The target grammage of the sheets was 62 g/m$^2$ with two different filler contents, i.e. 10 and 20%. A commercial PCC grade, Albacar LO, was used as a filler along with four different SuperFill fillers. In these SuperFill fillers, the PCC content was 56, 67, 78 and 82%.

SuperFill product was produced according to Example 1 of FI Patent Specification No. 100729.

Figure 6:
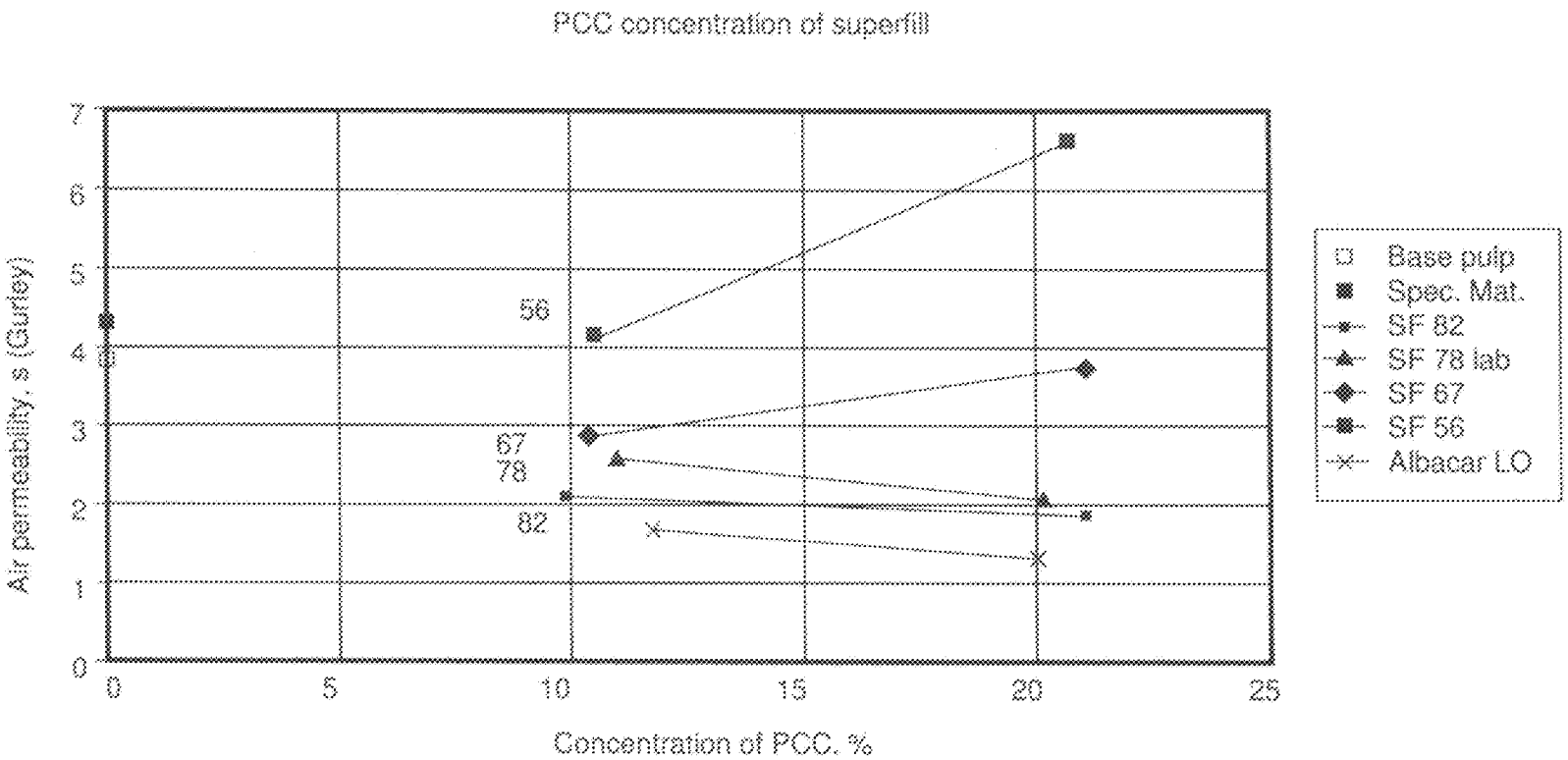

The results are shown in FIG. 6.

The finished SuperFill sheets were found to be denser than the PCC sheets. In addition to this, the SuperFill sheets become denser as the PCC content increases in sheets.

The increased density effect further increases, when changed into SuperFill qualities that have lower PCC contents.

The invention claimed is:

1. A method of producing a three-layer fiber product having a grammage of 25 to 60 g/m$^2$, the method comprising fitting on both sides of a middle layer consisting of at least one fiber layer, a fiber layer which contains a filler and which forms a surface layer of the fiber product, characterized in that the layers are formed by using a multilayer forming process wherein slush of pulp is layered in the headbox of a paper machine in such a way that filler and additives are added to the pulp used in the surface layers of the three-layer product, after which the pulps are fed separated from each other to the headbox and then immediately combined before the lip of the headbox, where the jet of the pulp slush is directed to the wire, and the filler of the surface layers consists at least partially of cellulose or lignocellulose fibrils, on which light-scattering material particles are deposited, the maximum content of which is 85% of the total weight of the filler;

the amount of said filler in the surface layers is 5-50% by weight of the fibers of the surface layer;

the grammage of each surface layer is approximately 2-20 g/m$^2$; and the ratio of the total weight of the surface layers in relation to the weight of the middle layer is 35/65 to 65/35.

2. The method according claim 1, characterized by using a filler, which comprises cellulose or lignocellulose fibrils produced from vegetable fibers by refining and screening, and having an average thickness of less than 5 μm.

3. The method according to claim 1, characterized in that the light-scattering material particles are deposited on fibrils, which correspond to a fraction that passes a 50 mesh screen and/or whose average thickness is 0.1-10 μm with an average length of 10-1500 μm.

4. The method according to claim 1, characterized in that the light-scattering material particles are inorganic salts that can be formed from their source materials by precipitating in an aqueous medium.

5. The method according to claim 4, characterized in that the light scattering material particles are calcium carbonate, calcium oxalate, calcium sulphate, barium sulphate or mixtures thereof.

6. The method according to claim 4, characterized in that the proportion of inorganic salts of the weight of the filler is 75-85% by weight.

7. The method according to claim 1, characterized in that the middle layer comprises chemical cellulose pulp.

8. The method according to claim 1, characterized in that the surface layers comprise mechanical pulp.

9. The method according to claim 1, characterized in that the middle layer and the surface layers each comprise a mixture of chemical cellulose pulp and mechanical pulp, and wherein a mechanical pulp, which is coarser than that used for forming the surface layers, optionally is used for forming the middle layer.

10. A method of producing a three-layer fiber product having a grammage of 25 to 60 g/m$^2$, the method comprising fitting on both sides of a middle layer consisting of at least one fiber layer, a fiber layer which contains a filler and which forms a surface layer of the fiber product, characterized in that the layers are formed by using a multilayer forming process wherein slush of pulp is layered in the headbox of a paper machine in such a way that filler and additives are added to the pulp used in the surface layers of the three-layer product, after which the pulps are fed separated from each other to the headbox and then immediately combined before the lip of the headbox, where the jet of the pulp slush is directed to the wire, and the filler of the surface layers consists at least partially of cellulose or lignocellulose fibrils, on which calcium carbonate particles are deposited in an amount of 60% to 85 % of the total weight of the filler;

the amount of said filler in the surface layers is 5-50% by weight of the fibers of the surface layer;

the grammage of each surface layer is approximately 2-20 g/m$^2$; and the ratio of the total weight of the surface layers in relation to the weight of the middle layer is 35/65 to 65/35.

11. The method according to claim 10, characterized in that the amount of calcium carbonate particles deposited on the cellulose or lignocellulose fibrils is 67% to 85% of the total weight of the filler.

12. The method according to claim 10, characterized in that the amount of calcium carbonate particles deposited on the cellulose or lignocellulose fibrils is 75% to 85% of the total weight of the filler.

* * * * *